US008770880B2

(12) United States Patent
Hecker

(10) Patent No.: US 8,770,880 B2
(45) Date of Patent: Jul. 8, 2014

(54) PEN OR PENCIL

(75) Inventor: Dieter Hecker, Nuremberg (DE)

(73) Assignee: STABILO International GmbH, Heroldsberg (DE)

( * ) Notice: Subject to any disclaimer, the term of this patent is extended or adjusted under 35 U.S.C. 154(b) by 338 days.

(21) Appl. No.: 13/140,298

(22) PCT Filed: Dec. 17, 2009

(86) PCT No.: PCT/EP2009/009087

§ 371 (c)(1),
(2), (4) Date: Aug. 5, 2011

(87) PCT Pub. No.: WO2010/069577

PCT Pub. Date: Jun. 24, 2010

(65) Prior Publication Data

US 2011/0286781 A1 Nov. 24, 2011

(30) Foreign Application Priority Data

Dec. 19, 2008 (DE) ..... 20 2008 016 889 U

(51) Int. Cl.
*A46B 5/02* (2006.01)

(52) U.S. Cl.
USPC ..... 401/6; 16/430; D19/47

(58) Field of Classification Search
USPC ..... 401/6, 88; 16/430; D19/47, 49
See application file for complete search history.

(56) References Cited

U.S. PATENT DOCUMENTS

| | | | | | |
|---|---|---|---|---|---|
| 3,093,172 | A | * | 6/1963 | Reed | 81/489 |
| 4,302,121 | A | * | 11/1981 | Kim | 401/209 |
| 4,526,547 | A | * | 7/1985 | Rusk | 434/166 |
| 6,409,407 | B1 | | 6/2002 | Schweizer | |

FOREIGN PATENT DOCUMENTS

| | | | |
|---|---|---|---|
| CA | 2022587 | C | 2/1991 |
| DE | 1709581 | U1 | 10/1955 |
| DE | 2655532 | | 6/1978 |
| DE | 29912153 | | 8/2000 |
| JP | 48051434 | U | 7/1973 |
| JP | 48099231 | U | 12/1973 |
| JP | 03101686 | U | 4/1991 |
| JP | 3-101686 | U | 10/1991 |
| JP | 03-227699 | | 10/1991 |
| JP | 3227699 | | 10/1991 |
| JP | 2004-066555 | | 3/2004 |
| JP | 2004066555 | | 3/2004 |
| JP | 2006021430 | A | 1/2006 |

* cited by examiner

*Primary Examiner* — David Walczak
(74) *Attorney, Agent, or Firm* — Bachman & LaPointe, P.C.

(57) ABSTRACT

A pen or pencil comprising a casing, the outside contour of which forms two or more gripping surfaces (12, 14, 16). There is at least one intermediate region (18, 20, 22) which is between two adjacent gripping surfaces in the peripheral direction and in which the outside contour of the casing is radially within a notional intersection line (24) of the two adjacent gripping surfaces.

10 Claims, 1 Drawing Sheet

PEN OR PENCIL

BACKGROUND OF THE INVENTION

The invention concerns a pen or pencil comprising a casing, the outside contour of which forms two or more gripping surfaces.

Pens or pencils of the above-indicated kind are known. They have edges where two adjacent gripping surfaces adjoin each other. Pens or pencils are known having two, three, four, six or edges, which in cross-section are in the form of a regular n-gon. In comparison the inside contour of the casing is usually of a different configuration from the outside contour thereof. For example it is circular-cylindrical. Therefore, accumulations of material occur in the region of the edges, and that is disadvantageous from economic and ecological points of view.

The object of the invention is to develop pens or pencils of the kind set forth in the opening part of this specification, in such a way that they are more advantageous in particular for economic and ecological reasons.

SUMMARY OF THE INVENTION

According to the invention the specified problem is achieved wherein there is at least one intermediate region which is between two adjacent gripping surfaces in the peripheral direction and in which the outside contour of the casing is radially within a notional intersection line of the two adjacent gripping surfaces.

In other words, in comparison with conventional pens or pencils, less material is used in the boundary region between two adjacent gripping surfaces, thereby achieving economic and ecological advantages.

Preferably in accordance with the invention the internal space of the casing is at least portion-wise circular-cylindrical. That configuration provides that the saving of material by the invention is particularly high. The internal space however can also be of an angular and in particular a rectangular cross-section.

To further increase the saving on material it is further preferred according to the invention if the outside contour of the intermediate region has exclusively concave and/or flat portions.

In a further preferred feature in accordance with the invention the outside contour of the intermediate region is U-shaped or V-shaped in cross-section. In other words with this configuration the casing is hollowed out or channeled in the boundary region between two adjacent gripping surfaces.

It is advantageous in accordance with the invention if the intermediate region extends in the peripheral direction over an angular region which is between 30% and 70% of that angular region over which one of the adjacent gripping surfaces extends, preferably between 40% and 60%, further preferably between 45% and 55%.

That configuration ensures that the gripping surfaces are of sufficient size.

To improve the appearance, in accordance with the invention a colour marking can be provided in the boundary region between the intermediate region and an adjacent gripping surface.

Preferably according to the invention at least one gripping surface is flat.

Additionally or alternatively it can be provided in accordance with the invention that at least one gripping surface is arcuate in cross-section, preferably in the form of a circular arc. With that configuration the notional intersection line is afforded by continuing the arc or circular arc.

Besides the above-described pen or pencil the invention also provides a casing for such a pen or pencil.

BRIEF DESCRIPTION OF THE DRAWINGS

The invention is described in greater detail hereinafter by means of a preferred embodiment by way of example with reference to the accompanying drawing in which.

DETAILED DESCRIPTION

Figure 1:
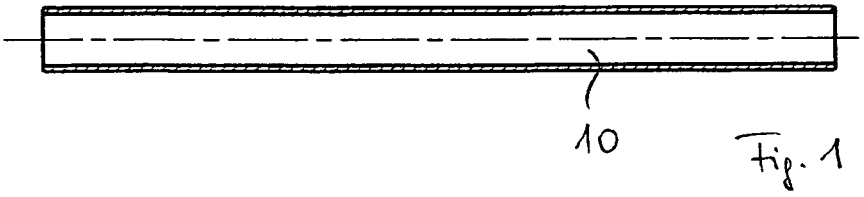
FIG. 1 shows a view in longitudinal section of a casing for a pen or pencil in accordance with a preferred embodiment of the invention.

The casing shown in the drawing has an internal space 10 of circular-cylindrical shape. Provided on the outside thereof are three gripping surfaces 12, 14 and 16 which each extend over an angular region $\alpha$ of about 73°. Disposed between the gripping surfaces 12, 14 and 16 are intermediate regions 18, 20 and 22 which each extend over an angular region $\beta$ of about 44°.

Figure 2:
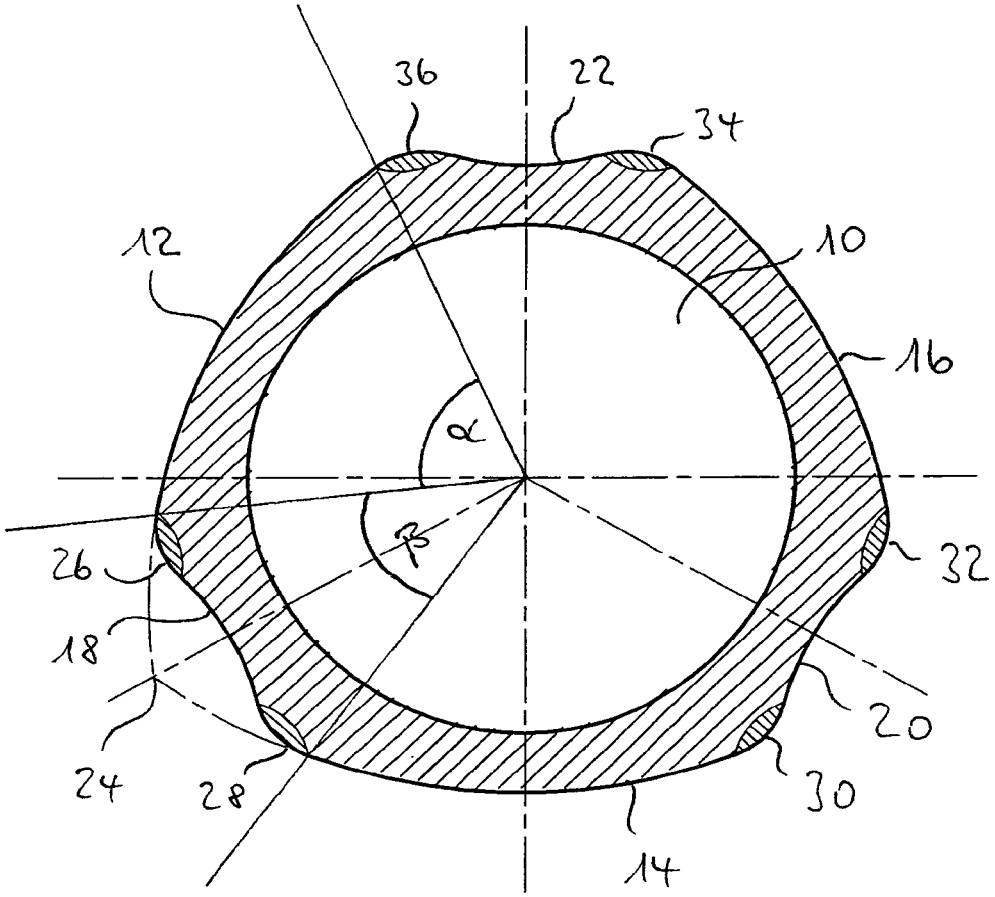
FIG. 2 shows a cross-sectional view of the casing of FIG. 1.

In the cross-sectional view in FIG. 2 the outside contours of the gripping surfaces 12, 14 and 16 are each on a circular arc. If the outside contour of the gripping surfaces 12 and 14 is extended along the respective circular arcs towards each other, they intersect in a notional intersection line 24. The outside contour of the intermediate region 18 is radially within the notional intersection line 24. A corresponding consideration applies to the outside contours of the intermediate regions 20 and 22.

Colour markings 26, 28, 30, 32, 34 and 36 are provided at the respective edges of the intermediate regions 18, 20 and 22. In the embodiment illustrated in the drawing the casing itself is yellow whereas the colour markings are kept white.

The outside contour of the intermediate regions 18, 20 and 22 is respectively concave between the respective colour markings 26, 28; 30, 32; 34, 36. Particularly in the case without colour marking or in the case where the colour marking is provided in the region of the gripping zones 12, 14, 16, the outside contours of the intermediate regions 18, 20 and 22 can also have exclusively concave and/or flat portions.

In addition the gripping surfaces 12, 14 and 16 can also be of different outside contours from that shown in the drawing, for example flat.

The features of the invention disclosed in the foregoing description, the claims and the drawing can be essential both individually and also in any combinations for implementing the invention in its various embodiments.

The invention claimed is:

1. A pen or pencil comprising a casing extending from a rear end of said pen or pencil to an area adjacent to a writing tip of said pen or pencil having an outside contour, the outside contour is provided with two or more arcuate gripping surfaces, at least one indented intermediate region located between two adjacent gripping surfaces in a peripheral direction, and the outside contour of the casing is radially within a notional intersection line of the two adjacent gripping surfaces, wherein the intermediate region extends in the peripheral direction over an angular region ($\beta$) which is between 30% and 70% of that angular region ($\alpha$) over which one of the adjacent gripping surfaces extends.

2. A pen or pencil according to claim 1, wherein an internal space of the casing is at least portion-wise circular-cylindrical.

3. A pen or pencil according to claim 1, wherein the outside contour of the intermediate region has concave and/or flat portions.

4. A pen or pencil according to claim 1, wherein the outside contour of the intermediate region is at least portion-wise U-shaped or V-shaped in cross-section.

5. A pen or pencil according to claim 1, wherein the intermediate region extends in the peripheral direction over an angular region (β) which is between 40% and 60% of that angular region (α) over which one of the adjacent gripping surfaces extends.

6. A pen or pencil according to claim 1, wherein the intermediate region extends in the peripheral direction over an angular region (β) which is between 45% and 55% of that angular region (α) over which one of the adjacent gripping surfaces extends.

7. A pen or pencil according to claim 1, further including a colour marking in a boundary region between the intermediate region and an adjacent gripping surface.

8. A pen or pencil according to claim 1, wherein at least one gripping surface is flat.

9. A pen or pencil according to claim 1, wherein at least one gripping surface is of an arcuate configuration in cross-section.

10. A pen or pencil according to claim 1, wherein at least one gripping surface is of a circular arcuate configuration in cross-section.

* * * * *